US006368138B1

(12) United States Patent
Huang

(10) Patent No.: US 6,368,138 B1
(45) Date of Patent: Apr. 9, 2002

(54) MODULE CARRIER

(76) Inventor: Huang Chou Huang, 5th Fl., No. 59-1, Section 1, Jiow Juang Street, Nang Kang, Taipei (TW)

( * ) Notice: Subject to any disclaimer, the term of this patent is extended or adjusted under 35 U.S.C. 154(b) by 0 days.

(21) Appl. No.: 09/819,524

(22) Filed: Mar. 27, 2001

(51) Int. Cl.[7] ..... H01R 13/62
(52) U.S. Cl. ..... 439/331; 439/71
(58) Field of Search ..... 439/331, 325–328, 439/330, 70, 71, 525, 526, 72

(56) References Cited

U.S. PATENT DOCUMENTS

| | | | | | |
|---|---|---|---|---|---|
| 5,443,404 | A | * | 8/1995 | Matsuoka | 439/331 |
| 5,545,050 | A | * | 8/1996 | Sato et al. | 439/331 |
| 6,152,744 | A | * | 1/2000 | Maeda | 439/331 |
| 6,241,545 | B1 | * | 6/2001 | Bricand et al. | 439/326 |

* cited by examiner

*Primary Examiner*—Hien Vu

(74) *Attorney, Agent, or Firm*—Pro-Techtor International Services

(57) ABSTRACT

A module carrier includes a liftable upper cover of metal and a plastic seat for securing modules. The bottom portion of the plastic seat is provided with a pair of plastic elements for receiving a plurality of terminals. The contact ends of the terminals have top edges provided with three or four contact points. The rear edge of the upper cover, which has a generally inverted U-shaped cross section, has round posts projecting from the inner portions on both sides thereof. The front edge has slightly lower projecting plates provided on both sides thereof. The upper end of each projecting plate is provided with a boss. The middle portion of the front edge is bent to form an actuating rib. Additionally, the end face is provided with front, rear and middle openings. A pair of downwardly inclined elastic plates are provided above each of the front and rear openings. The plastic seat is provided with front, rear and middle hot air inlets. The front and rear edges are provided with an indentation at either side for insertion of conductive terminal blocks. The end face between adjacent hot air inlets is provided with a plurality of holes for upward extension of the contact points to contact corresponding tin balls at the bottom portion of the modules.

3 Claims, 9 Drawing Sheets

MODULE CARRIER

BACKGROUND OF THE INVENTION (a) Field of the Invention

The invention relates generally to an electrical connector, more particularly a module carrier assembly for connecting a pair of module elements to a circuit board.

(b) Description of the Prior Art

The Bluetooth technique originates from a technology development project promoted by by Ericsson in 1994 with a purpose to solve the line connection problem associated with mobile telephone peripheral equipment. The Bluetooth technique combines wireless communication technology and digital communication technology to provide an effective wireless connection among all mobile devices, which include mobile telephones, wireless telephones, notebook computers, hand-held telephones, personal digital assistants (PDA), is digital cameras. All of these can be connected via Bluetooth. The pair of modules connected by the module carrier of this invention respectively have special functions of precision transmitters and receivers. The applications of these modules in the relevant equipment usually require them to be soldered to printed circuit boards. These forms of application require a considerable mounting force under the conditions that these circuit boards are being miniaturized and the connecting ends thereof are very fragile.

This invention is directed to an improved module carrier for connecting modules to a printed circuit board. When carrying the modules, the carrier can firmly position and protect the modules, and can form grounding loops to prevent electromagnetic interference.

SUMMARY OF THE INVENTION

Therefore, the primary object of this invention is to provide a terminal model that can firmly grip tin balls at the bottom portion of the modules, the contact of the terminal being formed with three or four contact points at a top edge thereof, and having preferred electrical conductivity.

Another object of this invention is to provide a carrier module that allows hot air to easily gain access thereinto and distributes to the terminals and tin paste so as to facilitate soldering and to enhance the efficiency of SMT process.

A further object of this invention is to provide a carrier module that is light and compact so as to meet the industry's demand for miniaturized products.

According to a preferred embodiment of this invention, the module carrier includes a liftable upper cover of metal and a plastic seat at the bottom. A pair of plastic seats for receiving a plurality of terminals are fitted into the bottom portion of the plastic seat. The terminals have contact ends with top edges forming three or four contact points that extend upwardly through holes in the plastic seat to firmly grip tin balls on the bottom portion of the module.

A plurality of conductive terminal blocks are fitted in indentations provided on both sides of each of front and rear edges of the plastic seat. The middle of the front indentation is provided with a longitudinal bottom edge open retaining groove. A projecting end face extends downwardly from substantially the middle of the indentation on the rear side. The middle of the top edge of the projecting end face is provided with a retaining groove. The back sides of front and rear conductive terminal blocks are respectively provided with a retaining block that gradually inclines and projects downward for insertion into the retaining grooves in the indentations of the plastic seat. The bottom side is vertically and outwardly bent to form a pair of suitably spaced-apart metal legs (to be soldered to the circuit board). The top face of the front conductive terminal block is connectedly provided with a pair of V-shaped conductive plates. The top edge of the rear conductive terminal block is bent outwardly to form a projecting retaining face, which is formed with a transverse groove. When the rear conductive terminal block is fitted into the corresponding indentation on the rear side of the plastic seat, the retaining face and the projecting end face define a suitably high receiving space so that the corresponding round post on the upper cover can perform forward and rearward slidable displacement as well as lifting and closing movements therein. After the upper cover is put in place, the top edge of the conductive terminal block can achieve a grounding loop therewith, with the elastic plates pressing the modules to prevent shaking thereof and achieve grounding (to filter electromagnetic waves). In the preferred embodiment, the upper cover is integrally punched from an electrically conductive material, such as stainless steel.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
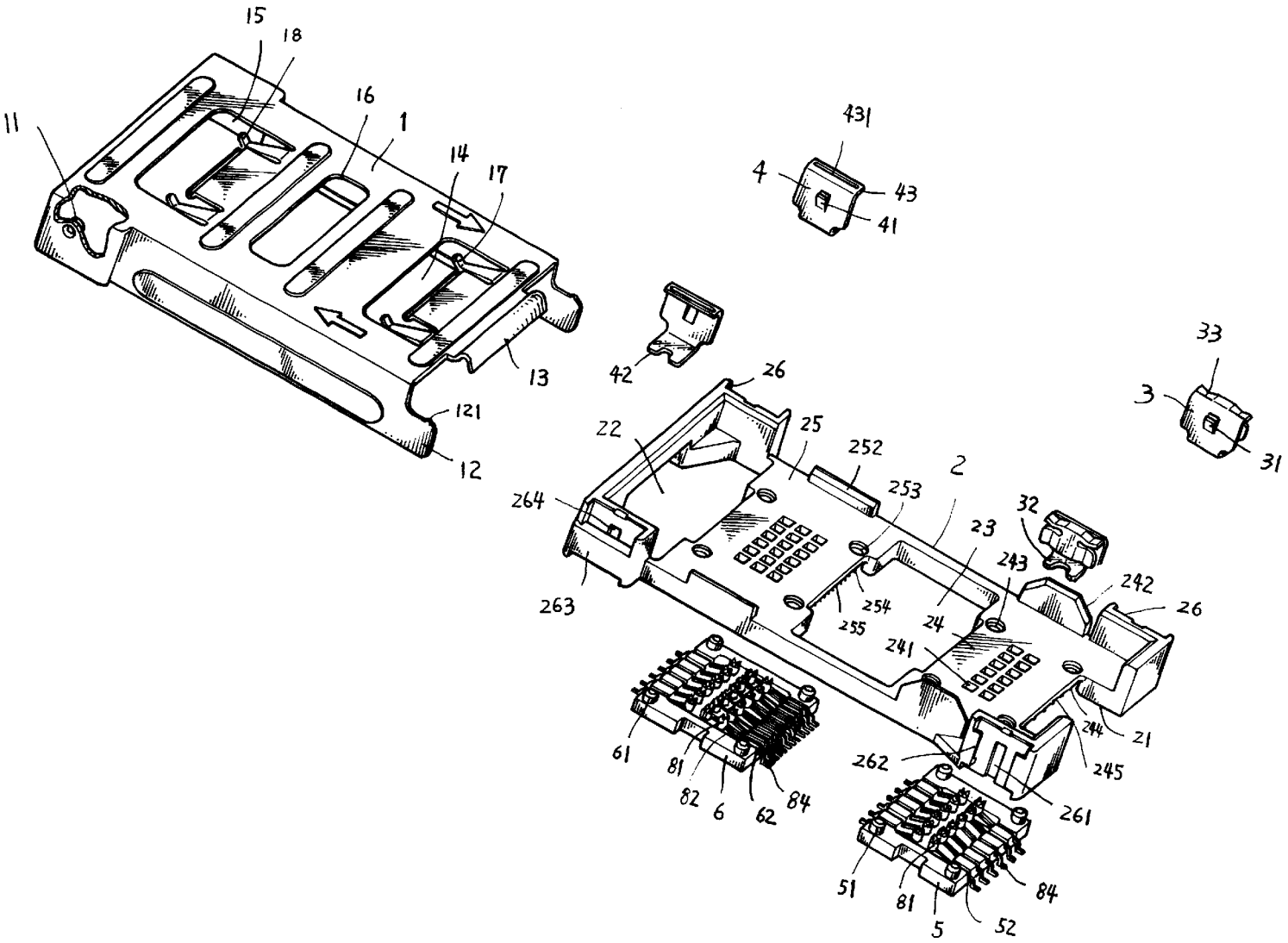
FIG. 1 is an exploded perspective view of the present invention.
Figure 2:
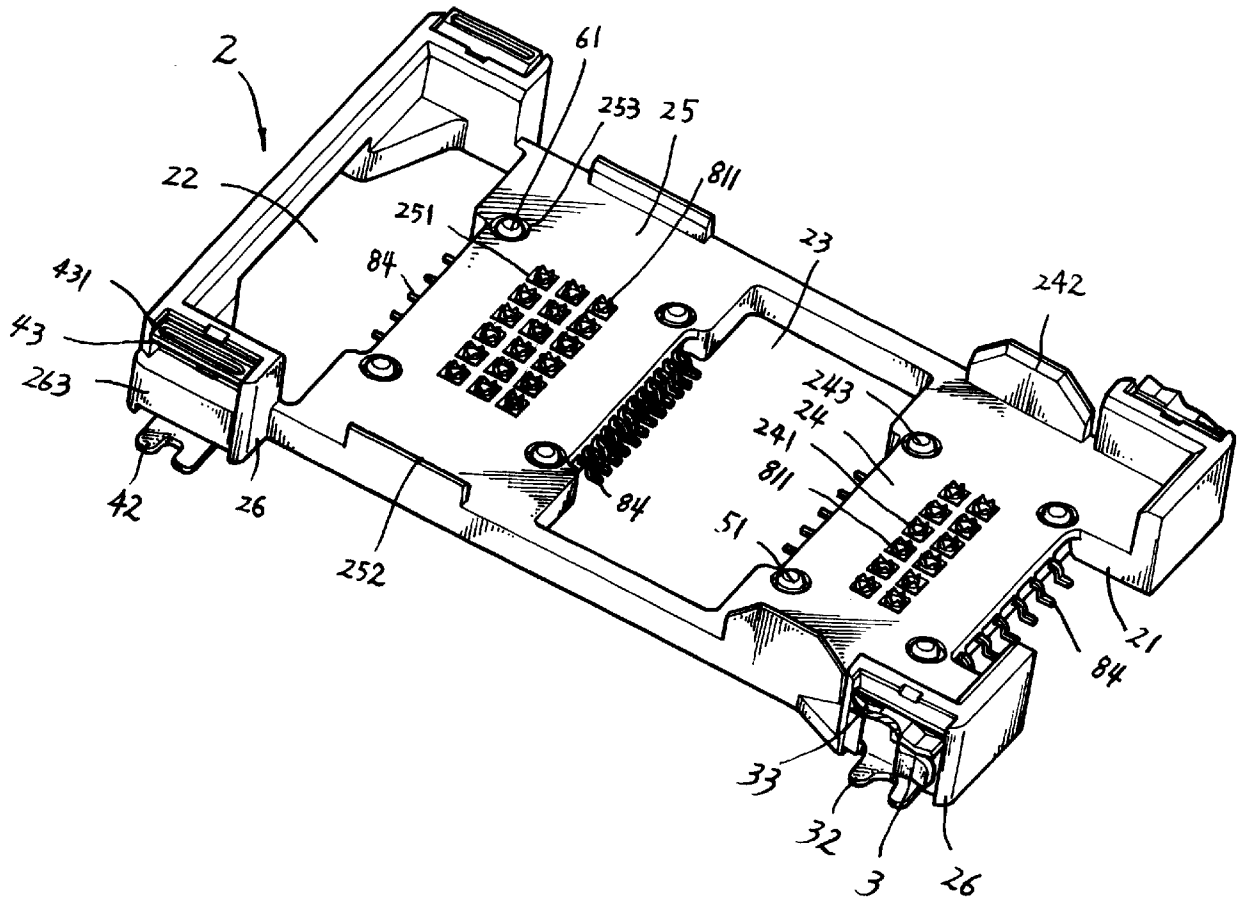
FIG. 2 is an assembled perspective view of a plastic seat of FIG. 1 in part.
Figure 3:
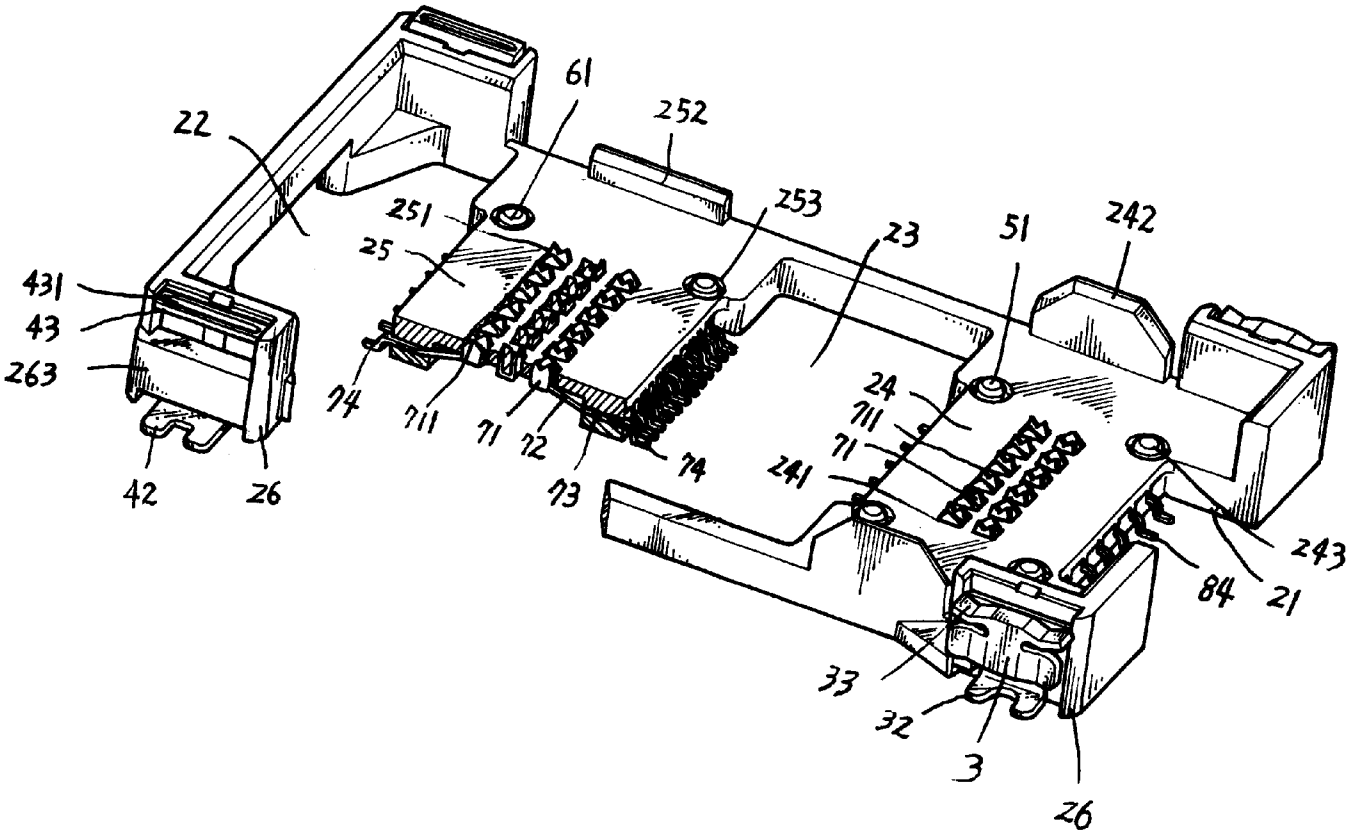
FIG. 3 is a sectional view of the plastic element of FIG. 2 in part.

With reference to the drawings, the present invention includes a metallic upper cover 1 punched from an electrically conductive material, such as stainless steel or similar material, and a plastic seat 2 located at the bottom side thereof. A pair of plastic elements 5, 6 for receiving a plurality of terminals 7 (or 8) are fitted in the bottom portion of the plastic seat 2. The top edges of the terminals 7 (or 8) form three or four contact points 711, 811.

The upper cover 1 is a rectangular housing having a generally inverted U-shaped cross section. The rear edge of the upper cover 1 has round posts 11 projecting from the inner portions on both sides thereof. The front edge has slightly lower projecting plates 12 provided on both sides thereof. The upper end of each projecting plate 12 is provided with a boss 121. The middle portion of the front edge is bent to form an actuating rib 13. Additionally, the end face is provided with front, rear and middle openings 14, 15, 16. A pair of downwardly inclined elastic plates 17, 18 are provided above each of the front and rear openings 14, 15.

The plastic seat 2 is a rectangular plate member. The end face thereof is provided with front, rear and middle hot air inlets 21, 22, 23. A plurality of holes 241, 251, are formed in carrier end faces 24, 25 between adjacent hot air inlets 21, 22, 23. The top edge of either side is provided with a pair of clamp plates 242, 252. The four adjacent corners are respectively provided with positioning holes 243, 253. A plurality of parallel ribs 244, 254 are spacedly arranged on the bottom side thereof such that adjacent ribs 244, 254 define a plurality of parallel grooves 245, 255 therebetween. In addition, the front and rear edges of the plastic seat 2 are respectively provided with an indentation 26 on either side thereof. The indentations 26 on the front side are respectively provided with a longitudinal bottom edge open retaining groove 261 in the middle, both sides of which are provided with a pair of clamping plates 262 slightly higher than the end face. The indentations 26 on the rear side are respectively provided with a projecting end face 263 at the lower middle portion thereof. The middle portion of the top edge of the projecting end face 263 is provided with a retaining groove 264.

The back side of each of front and rear conductive terminal blocks 3, 4 is provided with a retaining block 31, 41 that gradually inclines and projects downward for insertion into the retaining grooves 262, 264 in the indentations 26 of the plastic seat 2. The bottom side is vertically and outwardly bent to form a pair of suitably spaced-apart metal legs 32, 42 (to be soldered to the circuit board). The top face of the front conductive terminal block 3 is connectedly provided with a pair of V-shaped conductive plates 33. The top edge of the rear conductive terminal block 4 is bent outwardly to form a projecting retaining face 43, which is formed with a transverse elongate groove 431.

When the rear conductive terminal block 4 is fitted into the corresponding indentation 26 on the rear side of the plastic seat 2, the retaining face 43 and the projecting end face 263 define a suitably high receiving space so that the corresponding round post 11 on the upper cover 1 can perform forward and rearward slidable displacement as well as lifting and closing movements therein.

The plastic elements 5, 6 are generally rectangular hollow frame members, each of which is provided with a short post 51, 61 at each of the four end corners thereof, and each have an end face provided with a plurality of parallel grooves 52, 62 corresponding to the parallel ribs 244, 254 on the plastic seat 2.

Figure 4:
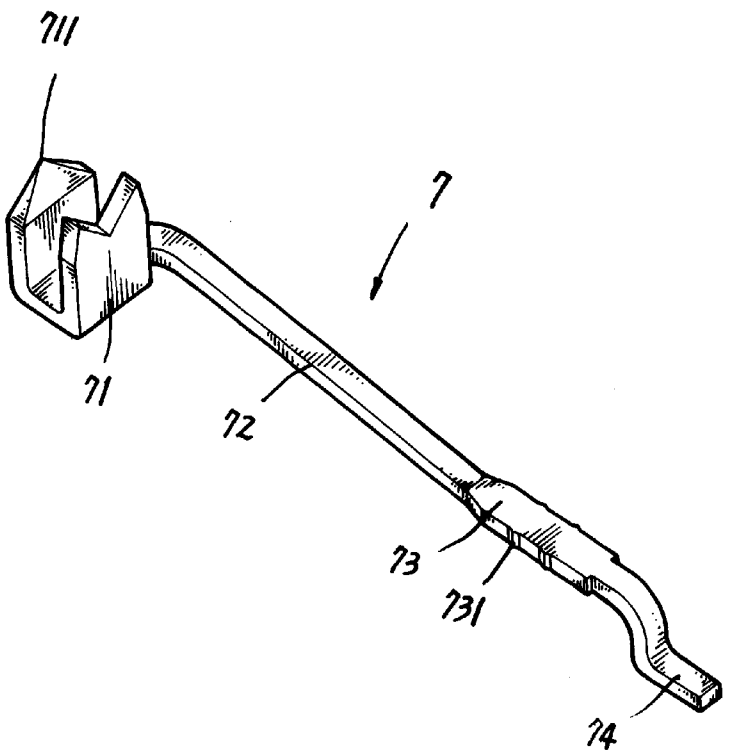
FIG. 4 is a perspective view of two terminal portions of the invention, showing the top edge of contact ends thereof forming three contact points.
Figure 4:
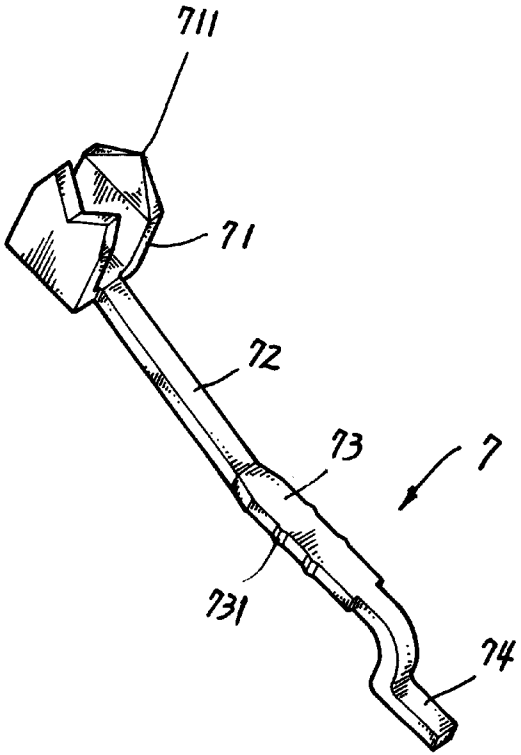
Figure 5:
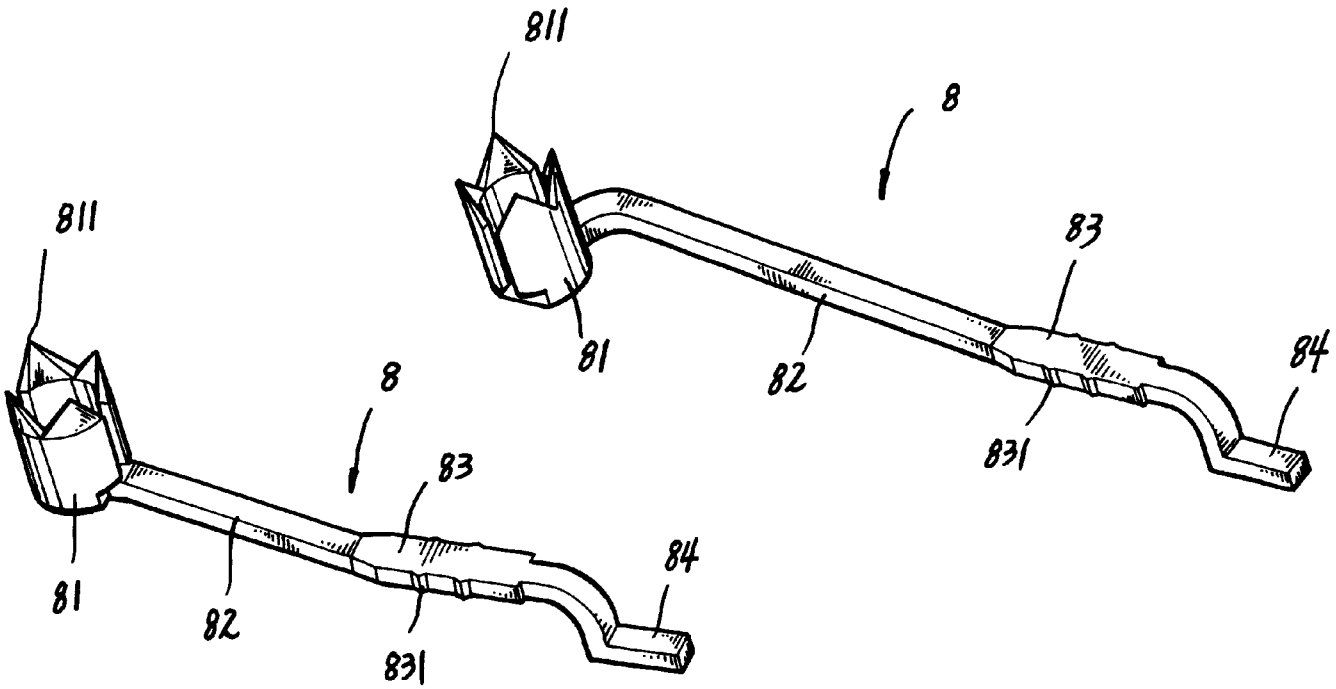
FIG. 5 is a perspective view of two other terminal portions of the invention, showing the top edge of contact ends thereof forming four contact points.
Figure 6:
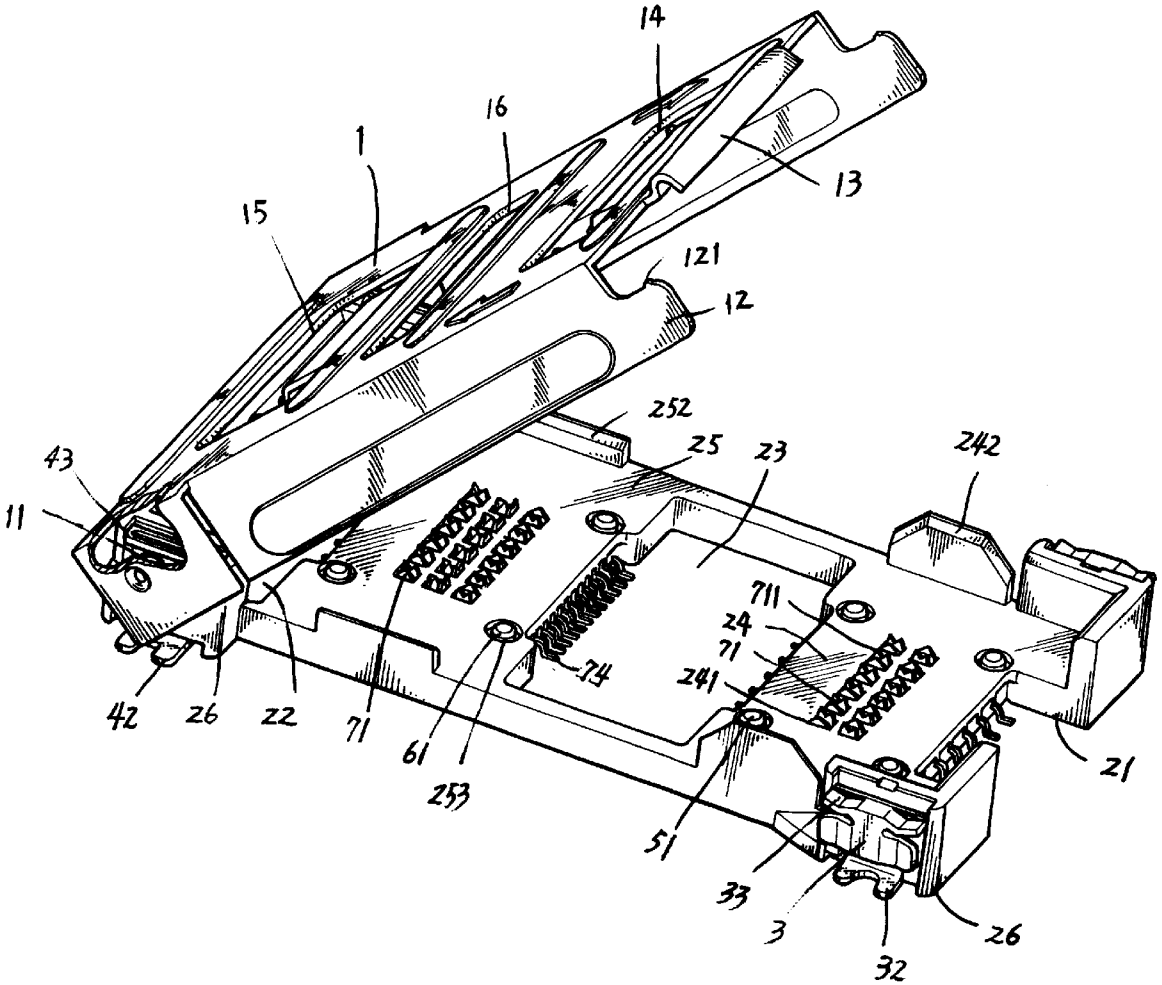
FIG. 6 is a perspective view of the invention, showing an upper cover in a lifted state.
Figure 7:
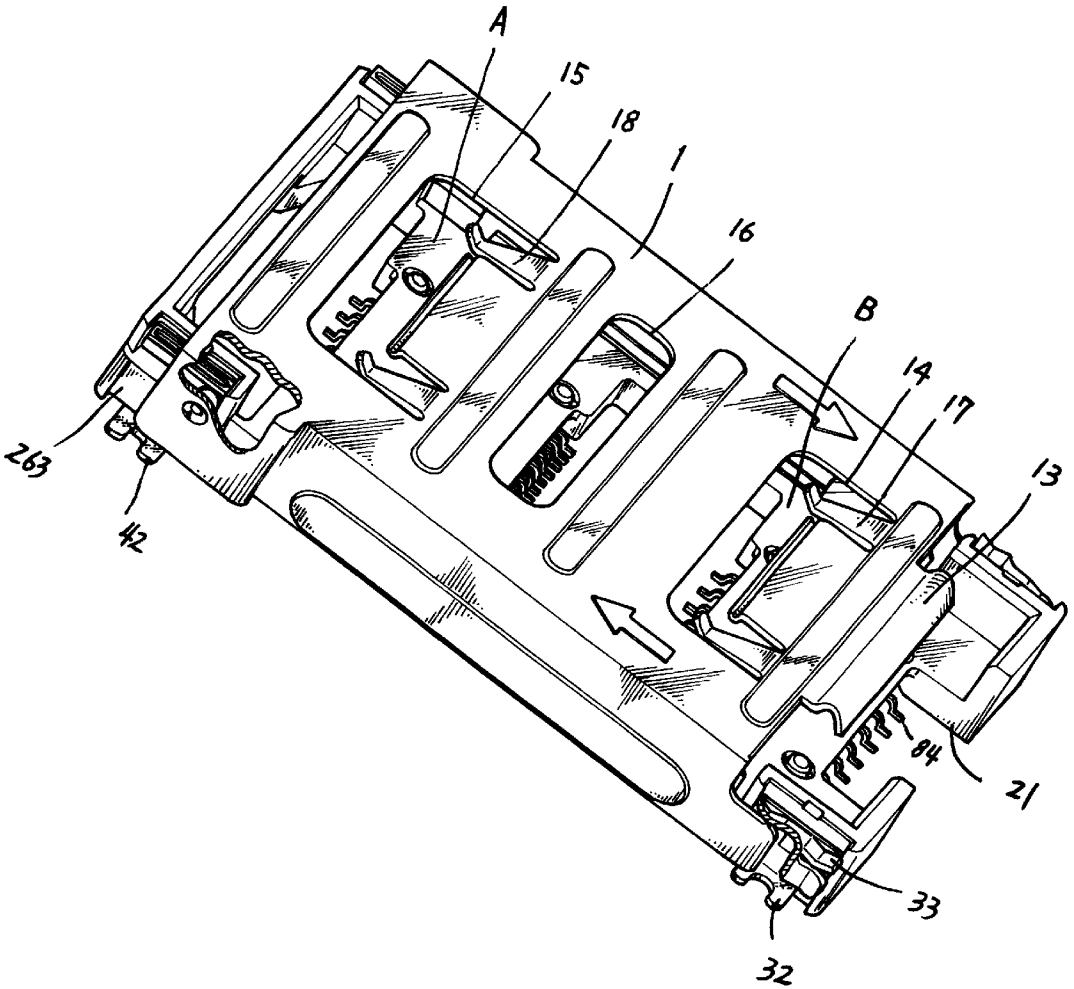
FIG. 7 is similar to FIG. 6, but showing the upper cover in place.

As shown in FIGS. 4 and 5, each of the terminals 7 (or 8) generally includes a contact end 71, 81 at the front end, an elongate force arm 72, 82 connected to the contact end 71, 81, a fixed end 73, 84 located rearwardly of the force arms 72, 82 and provided with projecting teeth 731, 831 on both sides thereof, and a solder end 74, 84 disposed at the rear edge of the fixed end 73, 83 and bent vertically downward and projecting forwardly.

As a matter of fact, the fixed ends 73, 83 of the terminals 7 (or 8) are fitted into the corresponding grooves 52, 62 of the plastic elements 5, 6 such that the contact ends 71, 81 thereof are opposite to each other, with the solder ends 74, 84 projecting outwardly of the plastic elements 5, 6.

Hence, the grooves 52, 62 of the plastic elements 5, 6 have secured therein a plurality of opposed terminals 7 (or 8), with the short posts 51, 62 at the four end corners fitted into the positioning holes 243, 253 in the plastic seat 2 from below. At the same time, the ribs 244, 254 on the underside of the plastic seat 2 fit into the grooves 52, 62 of the plastic elements 5, 6, and the downward pressing action upon the force arms 72, 82 brings the contact ends 71, 81 to extend upwardly and outwardly of the corresponding holes 241, 251.

Figure 8:
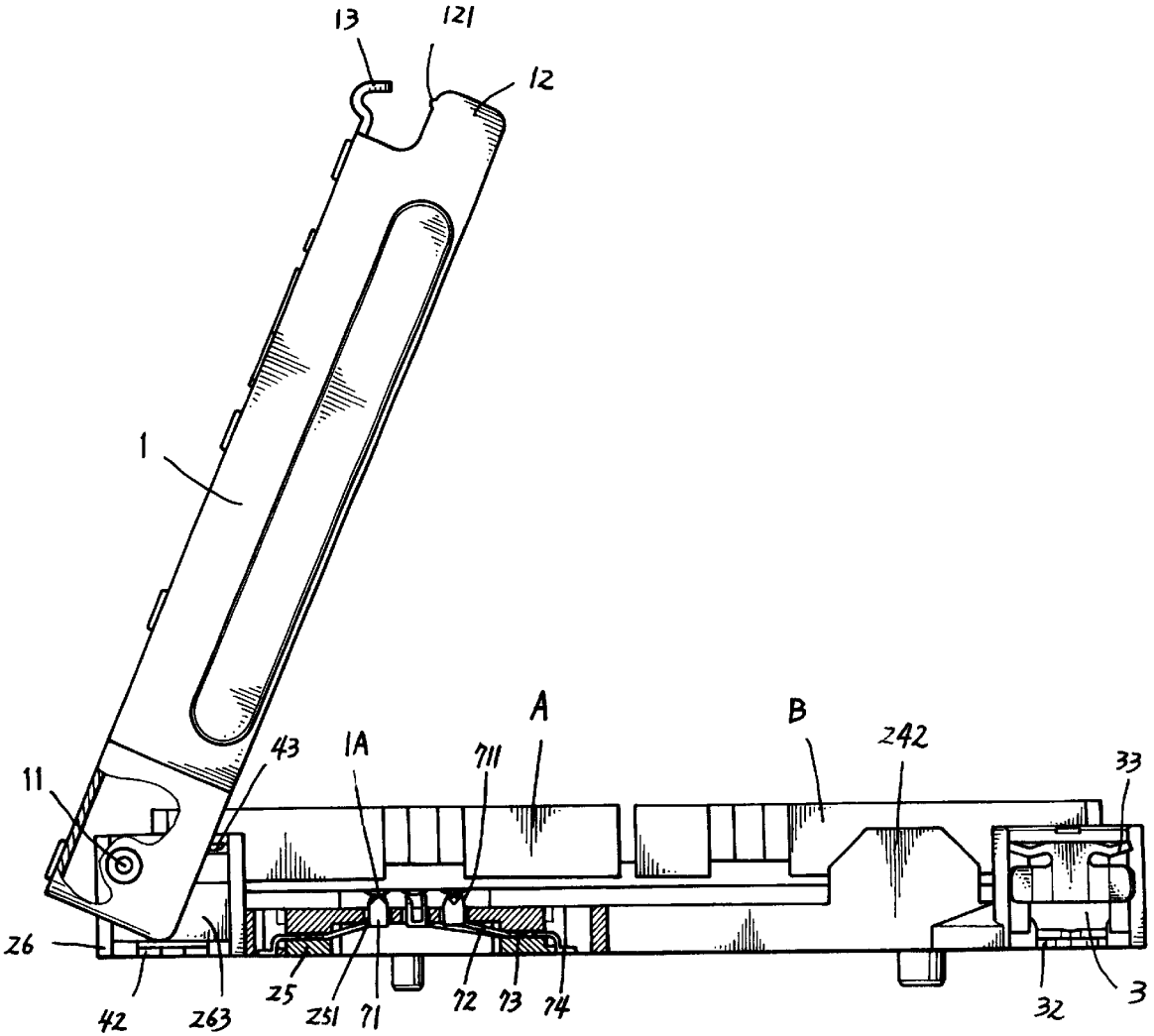
FIG. 8 is a partly sectional view of the invention, showing the upper cover in a lifted state after placement of modules.

The operation and procedures of mounting modules A, B to the plastic seat 2 are described hereinafter. The modules A, B are placed on the carrier end faces 24, 25, with both sides thereof clamped and secured by the clamp plates 242, 252. At this time, the tin balls 1A on the bottom portion of the modules A, B are just positioned above the holes 241, 251, where they can be gripped by the three or four contact points 711, 811 at the top edges of the contact terminals 71, 81 of the terminals 7 (or 8) that project from the holes 241 to achieve electrical connection (as shown in FIG. 8).

Figure 9:
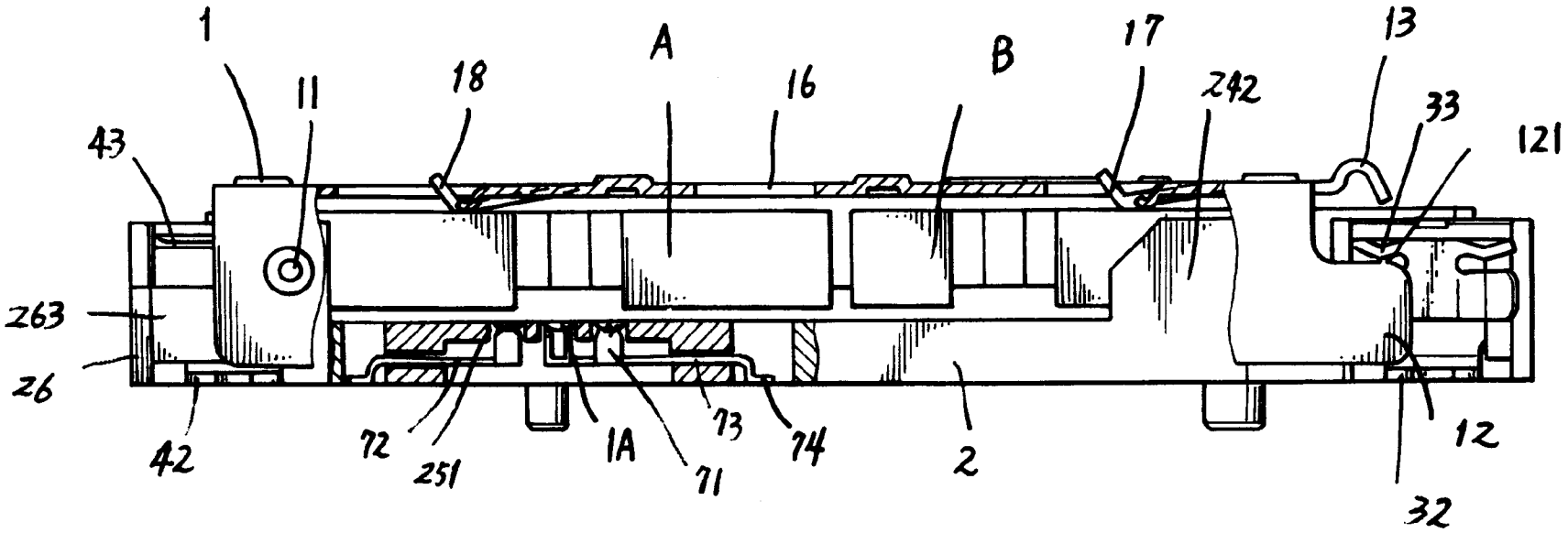
FIG. 9 is a partly sectional view of the invention of FIG. 8, showing the upper cover in place.

As shown in FIG. 9, when the upper cover 1 is put in place, the elastic plates 17, 18 thereon can be moved therewith to press downwardly upon the modules A, B to enhance the positioning effect and prevent shaking due to vibration, which may affect stability, and can achieve grounding by contacting the modules A, B. Besides, the end edges of the upper cover 1 can contact the V-shaped conductive plates 33 on the front and rear conductive terminal blocks 3, 4 simultaneously and form an electrical loop with the retaining faces 43 so as to filter off electromagnetic waves and hence their interference. Furthermore, the bosses 121 on the front edge projecting plates 17 of the upper cover 1 are retained and positioned on the inner side of the projecting middle point on the bottom side of the V-shaped conductive plates 33 on the top face of the front conductive terminal blocks 3.

Although the present invention has been illustrated and described with reference to the preferred embodiment thereof, it should be understood that it is in no way limited to the details of such embodiment but is capable of numerous modifications within the scope of the appended claims.

What is claimed is:

1. A module carrier adapted for connecting a pair of modules to a printed circuit board, said module carrier comprising:

a metal upper cover, which is a rectangular housing having a generally inverted U-shaped cross section, and has a rear edge provided with round posts projecting from inner portions on both sides thereof, a front edge provided with slightly lower projecting plates on both sides thereof, an upper end of each of said projecting plates being provided with a boss, a middle portion of said front edge being bent to form an actuating rib, an end face thereof being provided with front, rear and middle openings, a pair of downwardly inclined elastic plates being provided on each side of said front and rear openings;

a plastic seat, which is a rectangular plate member having an end face provided with front, rear and middle hot air inlets, a plurality of holes being formed in carrier end faces between adjacent ones of said hot air inlets, a top edge with both sides provided with a pair of clamp plates, four adjacent corners being respectively provided with positioning holes, a bottom side having a plurality of parallel ribs spacedly arranged thereon such that adjacent ones of said ribs define a plurality of parallel grooves therebetween, front and rear edges of said plastic seat being respectively provided with an indentation on either side thereof, said indentations on said front side being respectively provided with a longitudinal elongate bottom edge open retaining groove in the middle, both sides of which being provided with a pair of clamping plates slightly higher than said end face;

a pair of plastic elements, which are generally rectangular hollow frame members, each of which is provided with a short post at each of four end corners thereof, said short post being fitted into said positioning holes in said plastic seat from below, an end face of each of said plastic elements being provided with a plurality of parallel grooves corresponding to said parallel ribs on said plastic seat;

a pair of front and rear conductive terminal blocks, back sides of which are respectively provided with a retaining block that gradually inclines and projects downward for insertion into said retaining grooves in said indentations of said plastic seat, the bottom side thereof being vertically and outwardly bent to form a pair of suitably spaced-apart metal legs, said pair of front conductive terminal blocks having top faces connectedly provided with a pair of V-shaped conductive plates, said pair of rear conductive terminal blocks having top edges bent outwardly to form a projecting retaining face, which is formed with a transverse elongate groove; and a plurality of terminals, each or said terminals being a generally narrow sheet member and having a contact end at the front, said contact end having a generally U-shaped cross section, a top edge forming three contact points, an elongate force arm connected to said contact end, a fixed end disposed rearwardly of said force arm and provided with projecting teeth on both sides thereof, and solder ends disposed at a rear edge of said fixed end and bent vertically downward and projecting forwardly so that said fixed end is insertably disposed in said grooves, with the contact ends disposed oppositely, said solder ends projecting and extending outwardly of said plastic elements;

whereby a pair of modules are disposed on said carrier end face of said plastic seats, with both sides limited by said pair of clamp plates on said carrier end face, a plurality of tin balls on the bottom side thereof being positioned above said holes in said plastic seats such that said tin balls can be gripped by contact said three contact point of said terminals that extend outwardly of said holes to achieve electrical connection.

2. The carrier module of claim 1, wherein said retaining face and said projecting end define a suitably high receiving space when said rear conductive terminal block is fitted into a respective one of said corresponding indentations on the rear side of said plastic seat to prevent slippage thereof and to permit said round posts on said upper cover to perform forward and rearward slidable displacement as well as lifting and closing movements therein.

3. The module carrier of claim 1, wherein said cross section of each of said contact ends of said terminals may be configured to be a round surrounding member with a top edge forming four contact points.

* * * * *